United States Patent [19]

Wilson

[11] Patent Number: 4,819,800

[45] Date of Patent: Apr. 11, 1989

[54] TOOL STORAGE SYSTEM

[76] Inventor: Tony E. Wilson, 219 Skipper Dr., Port Orange, Fla. 32019

[21] Appl. No.: 179,207

[22] Filed: Apr. 4, 1988

[51] Int. Cl.[4] ..... B65D 25/10

[52] U.S. Cl. ..... 206/373; 211/70.6; 224/42.45 R

[58] Field of Search ..... 224/42.45 R; 211/70.6; 206/373, 375, 376, 377, 349

[56] References Cited

U.S. PATENT DOCUMENTS

| | | | |
|---|---|---|---|
| 1,223,161 | 4/1917 | Fazzini | 206/373 X |
| 3,878,939 | 4/1975 | Wilcox | 206/373 |
| 4,413,801 | 11/1983 | Lancaster et al. | 224/42.45 R |

FOREIGN PATENT DOCUMENTS

| | | | |
|---|---|---|---|
| 354937 | 6/1922 | Fed. Rep. of Germany | 206/373 |
| 858393 | 5/1940 | France | 206/373 |
| 1519783 | 2/1968 | France | 206/373 |
| 1090001 | 11/1967 | United Kingdom | 206/373 |
| 2035067 | 6/1980 | United Kingdom | 206/373 |

*Primary Examiner*—William Price
*Attorney, Agent, or Firm*—MacDonald J. Wiggins

[57] ABSTRACT

A tool box is formed of two identical shallow halves hinged together to have an open position for use and a closed position for carrying. A set of supports permit the box to be temporarily attached to a wall, such as the rear cab wall of a pickup truck or the like, in the open position providing access to tools held in a plurality of tool holders attached to planar walls of the box halves. The supports include resilient portions for quick release of the box halves. Handles on the tool box permit carrying in the closed position.

5 Claims, 1 Drawing Sheet

TOOL STORAGE SYSTEM

BACKGROUND OF THE INVENTION

1. Field of the Invention

The present invention relates to a tool storage system, and more particularly to a portable tool box and means for installation in a truck or shop providing easy access to stored tools.

2. Description of the Prior Art

Mechanics and repairmen who are required to make service calls commonly carry tools in conventional bulky tool boxes having little, if any, organization of the tools. Time is often wasted in searching through a jumble of small tools for a desired size wrench or the like. In many instances, the tool box is stored on the vehicle floorboard, taking up passenger foot space. Thus, there is a need for a portable tool box having holders to maintain tools in an organized fashion. Further, the tool box should have a shape factor to permit carrying in a vehicle without occupying passenger space, and be easily carried from the vehicle to a job site.

Prior art U.S. patents relevant to the present invention include the following: Ramer, U.S. Pat. No. 489,593; Earl, U.S. Pat. No. 3,443,851; Skafte et al, U.S. Pat. No. 4,155,609; McGoldrick, U.S. Pat. No. 4,209,212; Loeffel, U.S. Pat. No. 4,285,556; Blackmon, U.S. Pat. No. 4,480,744; and Schafer, U.S. Pat. No. 4,561,705.

SUMMARY OF THE INVENTION

The present invention is a tool box or case formed from a pair of hinged shallow halves that can be folded together and locked. The case includes handles for carrying when closed. A set of special hangers is provided which may be attached to the cab back wall behind the seat of a pickup truck or the like with the case open providing easy access to the tools. The case includes a plurality of tool holders having means for securely holding tools therein, organized by type and size. The repairman, when working from his truck, can quickly find a tool when needed. If the job is remote from the truck, the case may be removed from the mounting, closed, and latched. The handles permit carrying the case to the job where it can be opened for use.

It is therefore a principal object of the invention to provide a tool storage system including a tool box having individual tool holders to permit mounting on a wall in an open condition and to be removed and closed for carrying.

It is another object of the invention to provide a tool storage system having a shallow tool box mountable on the back cab wall of a pickup truck or the like and occupying minimum space.

It is still another object of the invention to provide a tool box having a holder for each individual tool with the tools distributed logically for ease of locating a required tool.

These and other objects and advantages will become aparent from the following detailed description when read in conjunction with the drawings.

DETAILED DESCRIPTION OF THE PREFERRED EMBODIMENT

Figure 1:
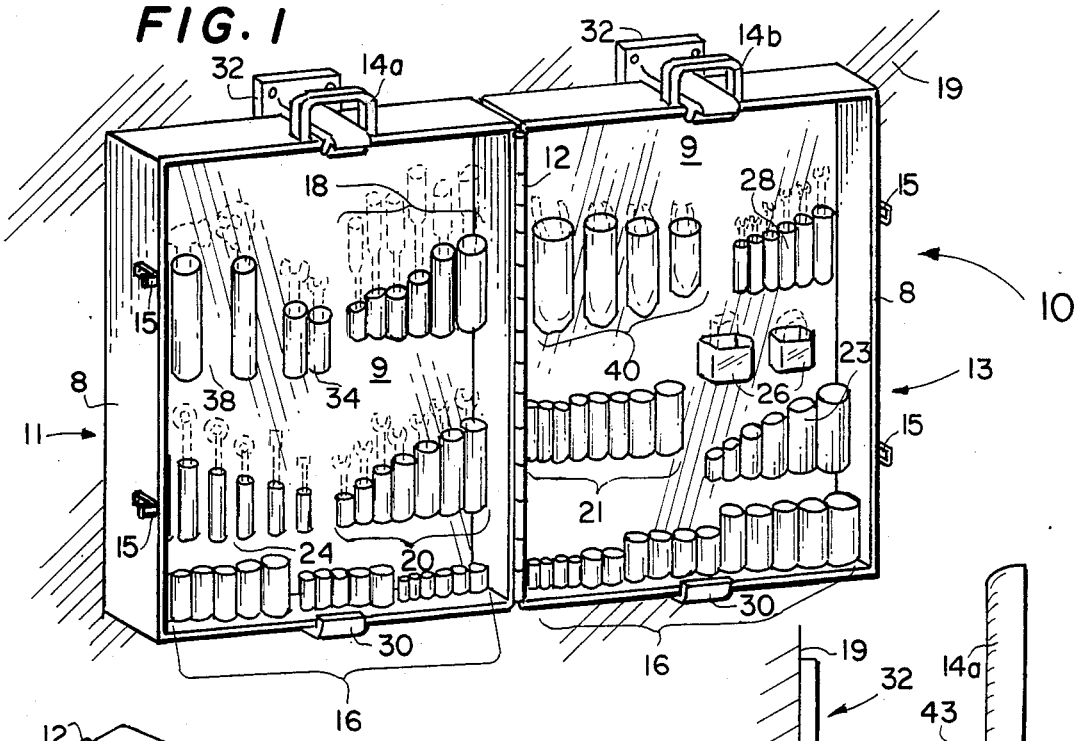
FIG. 1 is a view of the tool case of the invention in an open position mounted to a wall.

FIG. 1 shows a tool case 10, in accordance with the invention, temporarily mounted on a vertical wall 19. The case 10 includes a left essentially rectangular compartment 11 and a right compartment 13 having the same dimensions as compartment 11. Each compartment 11, 13 consists of a planar wall panel 9 and a rectangular side frame 8. Compartments 11 and 13 are joined along edges of frames 8 by a piano hinge 12. Any suitable material may be used such as steel, aluminum, or plastic. A pair of mating handles **14*a* and 14*b* are provided for carrying case 10 and locking clasps 15 are provided on frames 8. A plurality of tool holders is provided in which each holder is tailored to hold a specific tool. For example, holders 40 are configured for pliers; holders 28, 20, and 34 accept open end and box wrenches; and holders 18** accept screwdrivers. The holders are grouped in a logical fashion and graduated by size. The various holders are preferably formed from a resilient material such that a tool inserted into the holder will be gripped to be secure when the vehicle is in motion.

Box-like holders, such as 26, may hold roll-up rules and other small items. Holders 16 are grouped for various drive sizes of sockets with holders 21 and 23 sized for deep sockets. Drive handles and extensions are grouped together and are inserted in holders 24. As will now be recognized, the various holders can be shaped and distributed in case 10 as required by the user.

Figure 2:
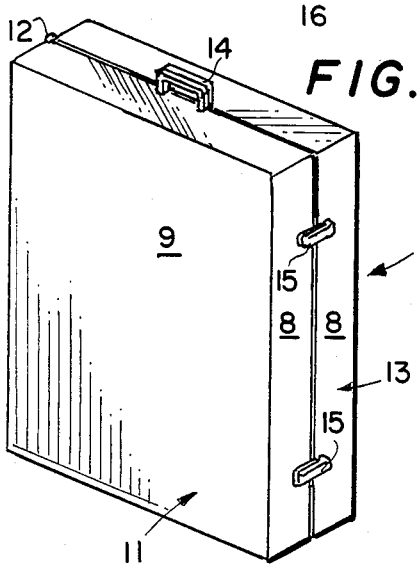
FIG. 2 is a view of the tool case of FIG. 1 in a closed position.
Figure 3:
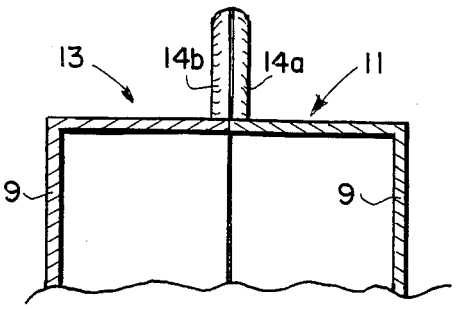
FIG. 3 is a cross-sectional view of the handle construction of the tool case of FIG. 1.

When case 10 is to be transported, it is removed from its wall mounting and closed as shown in FIG. 2. Clasps 15 are locked and case 10 can then be carried by handle 14. As seen in FIG. 3, handle **14*a* on compartment 11 mates with handle 14*b* on compartment 13** providing support for both compartments when carrying.

Figure 4:
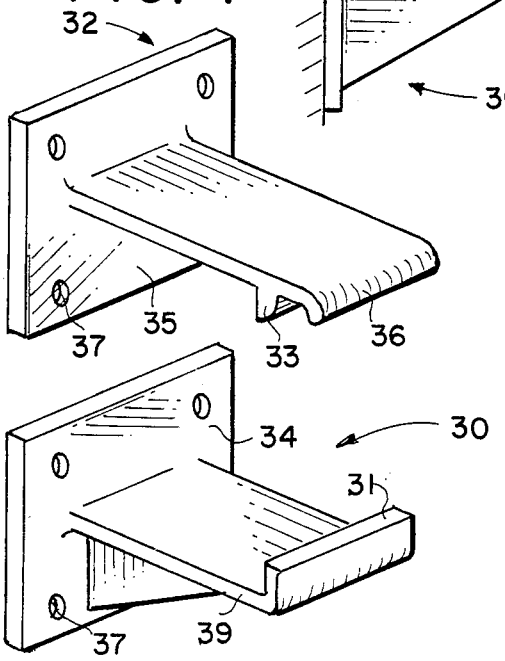
FIG. 4 is a perspective view of a set of wall hangers of the invention for the tool case.

To mount case 10 on a wall quickly and easily and to permit easy removal, a set of support hangers 30, 32 may be used, shown in perspective view in FIG. 4.

Lower hanger 30, preferably molded from plastic, includes a wall plate 34 with mounting holes 37 and having a shelf portion 31 extending therefrom. Upper hanger or support 32, molded from a resilient plastic, utilizes wall plate 35 with a clamp element 33 and grip portion 36 extending therefrom. Two pairs of hangers 30 and 32 are fastened to a wall and spaced in accordance with the size of case 10.

Figure 5:
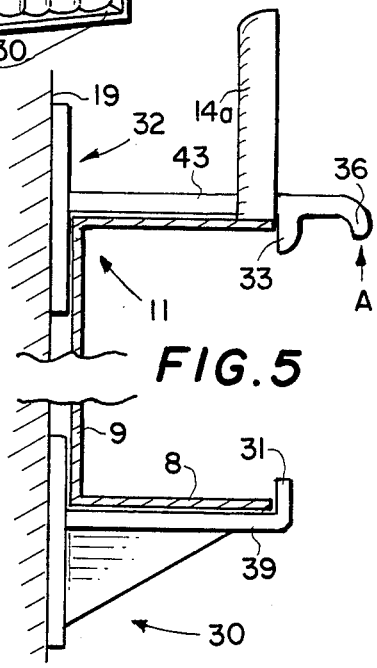
FIG. 5 is a cross-sectional view of the tool case of FIG. 1 through the plane 5—5.

FIG. 5 is a cross-sectional view of compartment 11 installed on wall 19 illustrating the use of hangers 30 and 32. The lower edge of compartment 11 rests in the upturned edge 31 of shelf 39 of hanger 30, and the upper edge is snapped into clamp element 33. Hangers 32 may be spaced to project through handles **14*a* and 14*b*. The resilience of the plastic of upper clamp element 43 allows easy release of case 10 by pushing upward on grip portion 36** as indicated by arrow A.

As will now be recognized, a tool storage system has been disclosed including a shallow tool case mountable on a wall in the open position which can be removed and closed for carrying. Although a specific embodiment has been used for exemplary purposes, modifications thereto may be made without departing from the spirit and scope of the invention.

I claim:

1. A tool box and supports comprising:

first and second, essentially identical and rectangular, shallow boxes hingedly attached together to permit closing to form a closed tool box, each of said boxes having a planar wall portion and a frame portion;

a pair of lower hangar supports for attachment to a vertical wall to receive and support a lower side of each of said frame portions when said tool box is in an open position;

a pair of upper hangar supports, each having an operable clamp element, said pair of upper supports for attachment to a vertical wall for clamping an upper side of each of said frame portions when said tool box is in an open position, said lower sides being supported by said pair of lower hangar supports;

a plurality of tool holders attached to said planar wall portion to hold tools in a vertical position when said open tool box is disposed in said upper and lower hangar supports;

locking means for locking said first and second shallow boxes together to form said closed tool box when removed from said upper and lower supports; and carrying means for carrying said closed tool box.

2. The tool box and supports as recited in claim 1 in which:

said lower hangar supports each includes a horizontal shelf portion having an upturned outer end thereof; and said upper hangar supports each have a horizontal portion having along an outer end thereof a downwardly projecting clamp element and a grip element, said horizontal portion formed of a resilient material.

3. The tool box and supports as recited in claim 1 in which said carrying means includes:

a horizontal upper portion of each of said frame portions having a carrying handle portion attached thereto wherein said handle portions mate together to form a single handle when said tool box is in a closed condition.

4. The tool box and supports as recited in claim 1 in which said tool holders are of varying shapes and sizes to hold a variety of tools.

5. A portable tool case for mounting, in an open condition, to a back cab wall of a pickup truck or the like to thereby provide access to stored tools, and having a closed condition when removed from said cab wall for carrying to a work site comprising:

(a) a pair of essentially identical rectangular shallow boxes, each having a frame portion and a planar wall portion;

(b) a hinge attached between portions of each of said frame portions to permit said boxes to be in an open coplanar condition for mounting to said wall and to be folded together to form a closed case for carrying;

(c) a lock attached to said frame portions for securing said boxes together when closed;

(d) a carrying handle having a handle portion attached to an upper element of each of said frame portions, said handle portions mating to form a single handle when said case is closed;

(e) a plurality of varying shapes and sizes of tool holding elements attached to each of said planar wall portions; and (f) a set of wall mounted supports for said tool chest having (i) lower supports, each having a horizontal shelf portion with an outer end thereof upturned, and (ii) upper supports, each having a resilient horizontal portion with a downwardly projecting clamp element and a handgrip element at the outer edge thereof, said upper and lower supports attached to said cab wall for supporting lower frame portions of said shallow boxes and for engaging upper frame portions when said case is open.

* * * * *